US010830256B2

(12) United States Patent
Brenneis et al.

(10) Patent No.: US 10,830,256 B2
(45) Date of Patent: Nov. 10, 2020

(54) TWO-STAGE VALVE ARRANGEMENT FOR HYDRAULIC CONTROL OF A PISTON-CYLINDER ARRANGEMENT OF A HIGH- OR MEDIUM-VOLTAGE POWER SWITCH

(71) Applicant: ABB Power Grids Switzerland AG, Baden (CH)

(72) Inventors: Thomas Brenneis, Mainaschaff (DE); Matthias E. Schmidt, Frankfurt (DE); Thomas Klose, Linsengericht Grossenhausen (DE); Niko Robens, Hofheim am Taunus (DE)

(73) Assignee: ABB POWER GRIDS SWITZERLAND AG, Baden (CH)

( * ) Notice: Subject to any disclaimer, the term of this patent is extended or adjusted under 35 U.S.C. 154(b) by 185 days.

(21) Appl. No.: 16/062,227

(22) PCT Filed: Nov. 30, 2016

(86) PCT No.: PCT/EP2016/079284
§ 371 (c)(1),
(2) Date: Jun. 14, 2018

(87) PCT Pub. No.: WO2017/102331
PCT Pub. Date: Jun. 22, 2017

(65) Prior Publication Data

US 2019/0017521 A1 Jan. 17, 2019

(30) Foreign Application Priority Data

Dec. 14, 2015 (DE) ..... 10 2015 121 719

(51) Int. Cl.
*F15B 13/04* (2006.01)
*F15B 11/00* (2006.01)
(Continued)

(52) U.S. Cl.
CPC ..... *F15B 11/006* (2013.01); *F15B 13/0431* (2013.01); *H01H 33/34* (2013.01);
(Continued)

(58) Field of Classification Search
CPC ..... F15B 11/006; F15B 13/0431; F15B 13/0405; F15B 2211/30575; F15B 2211/329; F15B 2211/7052; H01H 33/34
(Continued)

(56) References Cited

U.S. PATENT DOCUMENTS 3,038,449 A * 6/1962 Murphy, Jr. ..... F15B 21/08 91/31
4,706,932 A 11/1987 Yoshida et al.
(Continued)

FOREIGN PATENT DOCUMENTS

DE 1020009053901 B3 4/2011
EP 2234135 A2 9/2010
(Continued)

OTHER PUBLICATIONS

International Search Report from PCT/EP2016/079284, dated Mar. 16, 2017, 5 pages (including English translation).
(Continued)

*Primary Examiner* — Minh Q Le
(74) *Attorney, Agent, or Firm* — Sage Patent Group

(57) ABSTRACT

A valve arrangement for hydraulic control of a piston-cylinder of a power switch contains a main stage having a first main valve and a second main valve, and a pilot stage having at least one pilot valve. In order to permit the first main valve to remain securely in the opened state, even in the event of pressure oscillations, the main valve has a total of four control surfaces, of which a second and a third control surface operate in a closing manner and a fourth control surface operates in an opening manner. For this
(Continued)

purpose, the second control surface is connected to the high-pressure line, the third control surface is connected to the low-pressure line, and the fourth control surface is connected to the output-side valve connection of the first main valve.

10 Claims, 4 Drawing Sheets

(51) Int. Cl.
*F15B 13/043* (2006.01)
*H01H 33/34* (2006.01)

(52) U.S. Cl.
CPC . *F15B 13/0405* (2013.01); *F15B 2211/30575* (2013.01); *F15B 2211/329* (2013.01); *F15B 2211/7052* (2013.01)

(58) Field of Classification Search
USPC ..... 137/596.18, 596.16; 251/25, 57
See application file for complete search history.

(56) References Cited

U.S. PATENT DOCUMENTS 5,816,132 A * 10/1998 Langner ..... B66D 3/18 91/391 R
9,250,632 B2 * 2/2016 Tondolo ..... F15B 20/008
2002/0026869 A1 * 3/2002 Morita ..... B23Q 1/58 91/465
2003/0106313 A1 * 6/2003 Huang ..... F15B 11/006 60/433
2004/0200349 A1 * 10/2004 Moler ..... F15B 9/09 91/465
2008/0295681 A1 * 12/2008 Ma ..... E02F 3/7618 91/446
2010/0243927 A1 9/2010 Wahlefeld et al.
2012/0037251 A1 * 2/2012 Ohmer ..... F15B 11/006 137/637
2012/0280152 A1 11/2012 Schmidt et al.
2015/0300510 A1 10/2015 Schmidt et al.

FOREIGN PATENT DOCUMENTS

EP 2933816 A1 10/2015
GB 2041170 A 9/1980
JP 59158026 A 9/1984

OTHER PUBLICATIONS

Written Opinion of the ISA from PCT/EP2016/079284, dated Mar. 16, 2017, 11 pages (including English translation).

* cited by examiner

TWO-STAGE VALVE ARRANGEMENT FOR HYDRAULIC CONTROL OF A PISTON-CYLINDER ARRANGEMENT OF A HIGH- OR MEDIUM-VOLTAGE POWER SWITCH

CROSS-REFERENCE TO RELATED APPLICATIONS

This application is a U.S. national stage of International Application Serial No. PCT/EP2016/079284, filed Nov. 30, 2016, which claims priority to German Patent Application No. 102015121719.8, filed Dec. 14, 2015. The entire disclosures of each of the foregoing applications are hereby incorporated by reference.

TECHNICAL FIELD

The invention relates to the field of the hydraulic actuation of a piston/cylinder arrangement by means of a valve arrangement, the valve arrangement belonging to a drive for actuating a high voltage or medium voltage power switch. On account of the interaction of hydraulics and mechanics, the drive is also called a hybrid mechanical drive. Here, high voltage is understood to mean the voltage range above 50 kV, whereas the range between 1 and 50 kV is considered to be medium voltage.

BACKGROUND

EP 2 234 135 B1 and DE 10 2009 053 901 B3 have disclosed in each case two-stage valve arrangements for the actuation of a piston of a hydraulic drive, the hydraulic drive being provided to actuate a high voltage power switch. The valve stages comprise a pilot control stage and a main stage.

The valve arrangement of EP 2 234 135 B1 consists of a 3/2-way valve as a pilot control valve and two 2/2-way valves as main valves, whereas there are likewise two 2/2-way valves as main valves in the valve arrangement of DE 10 2009 053 901 B3, but the function of the 3/2-way pilot control valve is performed by way of two 2/2-way valves as pilot control valves.

FIG. 1 shows the valve arrangement of EP 2 234 135 B1 together with the piston/cylinder arrangement which is actuated by way of the valve arrangement, and the high voltage power switch 7 which is to be actuated. The valve arrangement and the piston/cylinder arrangement together belong to a hydraulic drive for the actuation of the high voltage power switch.

In a first position of the pilot control valve 11, the path is opened from a high pressure accumulator 9 via a first main valve 1 to a space 10 which is situated within the cylinder 12 and above the piston 6, that is to say the fluid under high pressure is fed to the space 10 above the piston 6, with the result that the high voltage power switch 7 is closed. The fluid is usually formed by a hydraulic oil. In a second position of the pilot control valve 11, the space 10 is connected via a second main valve 2 to a low pressure tank 8, that is to say the space 10 above the piston 6 is relieved of pressure, as a result of which the piston 6 moves back and opens the high voltage power switch 7.

The alternative valve arrangement of DE 10 2009 053 901 B3 can be seen in FIG. 2, once again together with the piston/cylinder arrangement (6, 12) of the hydraulic drive, and the switch 7 which is to be actuated. Identical elements to FIG. 1 have the same designations, and the fundamental method of operation of the valve arrangement is the same as described above for FIG. 1.

The first and second pilot control valves 3 and 4 of FIG. 2 are configured as NC valves which are actuated electrically and are reset by spring. As a result of the technically necessitated spring resetting, the situation always arises after switching operation that an enclosed oil volume is produced in the pilot control region, that is to say in the hydraulic region of the pilot control stage, which oil volume is responsible for the correct positioning of the first main valve 1 and the second main valve 2 of the main stage for the time duration up to the next switching operation.

The 2/2-way valves 3 and 4 of the pilot control stage are never completely without leaks, however. Depending on the switching position, the internal leakage at the pilot control valves 3 and 4 can then lead to an undesired pressure build up or dissipation, which might endanger the correct positioning of the main valves 1 and 2. In DE 10 2009 053 901 B3, the problem is solved by virtue of the fact that a small orifice or throttle 5 is installed between the pilot control region, that is to say the hydraulic region in which the oil is enclosed, and the main control region, that is to say the region which drives the main piston 6. Specifically, the throttle 5 is situated between the outlet side X of the pilot control valves 3, 4 which is connected to the control inlets of the main valves 1, 2 and the outlet side Z of the main valves 1, 2 which is connected to the space 10 of the piston/cylinder arrangement (6, 12).

It is proposed in EP 2933816 A1 to use a shuttle valve instead of the throttle, to be precise in such a way that the shuttle valve makes a passage possible up to a predefined volumetric flow or up to a predefined pressure difference, and disconnects the two pressure lines which are connected to the valve from one another above said predefined volumetric flow or said predefined pressure difference. Here, the hydraulic valve is active in an identical manner in the two volumetric flow directions.

The following disadvantages have then been determined with regard to the valve arrangement (FIG. 2) which is known from DE 10 2009 053 B3: the first main valve 1 has three control faces F1, F2, F3, with the area ratio F1=F2 30 F3. Here, F1 acts in an opening manner for the first main valve 1, and F2 and F3 act in a closing manner. If the first main valve 1 is opened, the high voltage power switch 7 is closed, that is to say switched on.

After said switching on operation has ended, the same pressure, to be precise high pressure, acts on all three control faces F1, F2, F3 of the first main valve 1. On account of the equality of the size of the first control face F1 with respect to the sum of the sizes of the second control face F2 and the third control face F3, the forces in the direction of opening and closing of the first main valve 1 are then in equilibrium. In this state, that is to say the stationary switched on state of the high voltage power switch 7, the first main valve 1 is held open merely by way of the spring latching means 13 which is comparatively weak in comparison with the pressure forces which act. Here, the second control face F2 is subject to a pressure which is dependent to an appreciable extent on the flow of the hydraulic oil.

Since the actually acting pressure is dependent on the really existing throughflow of the first main valve 1, it occurs that the balance of forces between the forces of the control faces F1, F2 and F3 is no longer equalized, but rather changes at times in such a way that the force which is generated by way of the second control face F2 rises. As a result, the opening force which is generated by the first control face F1 is lower than the sum of the closing forces of the second and third control faces F2 and F3, and the first main valve 1 closes. Although the flow which changes as a result therefore again reduces the closing force which acts by way of the second control face F2, with the result that the first main valve 1 is in equilibrium again, the equilibrium of forces does not bring about renewed opening of the first main valve 1, but rather said first main valve 1 remains in the current closed state. The first main valve 1 remaining in the closed position in this way with a simultaneous switched on state of the high voltage power switch 7 is undesired, since it prevents the leakage equalization in the control region between the main valves 1 and 2 on account of the disconnection of the control lines from the high pressure accumulator 9. This can have the consequence that either undesired opening and therefore switching off of the high voltage power switch 7 takes place on account of a leakage in the X-region, or even undesired switching off which takes place slowly on account of a leakage in the Z-region. Both situations are a significant malfunction of the hybrid mechanical drive.

If the flow change at the second control face F2 again occurs during the switching on operation of the high voltage power switch 7, said switching on operation is slowed greatly. Slow switching on of this type is likewise classified as a significant functional fault of the hybrid mechanical drive.

SUMMARY

It is an object of the invention to specify a valve arrangement for the hydraulic actuation of a piston/cylinder arrangement of a high voltage or medium voltage power switch, by way of which valve arrangement the above-described problems of undesired and/or slow switching off or slow switching on of the high voltage power switch can be eliminated.

According to the invention, said object is achieved by way of the features of claim 1.

Here, the starting point is the known two-stage valve arrangement according to FIG. 1 or 2 for the hydraulic actuation of a piston in a cylinder of a high voltage or medium voltage power switch, comprising a main stage with a first main valve which is configured as a 2/2-way valve and a second main valve which is configured as a 2/2-way valve, a high pressure line (P) which conducts a fluid under high pressure in the operating state of the valve arrangement being connected directly to an inlet-side valve connector of the first main valve, and a low pressure line which conducts a fluid under low pressure being connected directly to an inlet-side valve connector of the second main valve, and a pilot control stage with at least one pilot control valve, which pilot control stage has two connectors on the inlet side, one of the connectors being connected to the high pressure line and the other one of the connectors being connected to the low pressure line, an outlet-side valve connector of the first main valve and an outlet-side valve connector of the second main valve being connected hydraulically to one another and to a space which is situated on one side of the piston, a hydraulic pilot control outlet of the pilot control stage being connected both to a first control face, acting in an opening manner, of the first main valve and to a first control face, acting in a closing manner, of the second main valve, the pilot control stage establishing a connection between the high pressure line and the hydraulic pilot control outlet in a first position of the at least one pilot control valve, as a result of which the high pressure which acts on the first control faces of the main valves brings about opening of the first main valve and closing of the second main valve, with the result that fluid under high pressure is fed to the space which is situated on one side of the piston, and the pilot control stage establishing a connection between the low pressure line and the hydraulic pilot control outlet in a second position of the at least one pilot control valve, as a result of which the low pressure which acts on the first control faces of the main valves brings about closing of the first main valve and opening of the second main valve, with the result that fluid is discharged in the direction of the low pressure line from the space which is situated on one side of the piston.

In accordance with the invention, the first main valve has a total of four control faces, that is to say three further control faces in addition to the first control face of the main valve, of which three further control faces a second and a third control face of the first main valve act in a closing manner and a fourth control face of the first main valve acts in an opening manner. Here, the second control face of the first main valve is connected to the high pressure line; the third control face of the first main valve is connected to the low pressure line; and the fourth control face of the first main valve is connected to the outlet-side valve connector of the first main valve.

Here, the size ratio of the control faces of the first main valve which act in an opening manner with respect to the control faces of the first main valve which act in a closing manner is such that a resulting force which acts in an opening manner remains in force in the open state of the first main valve. The latter is in contrast to the known embodiment in accordance with FIG. 2, in the case of which an equilibrium of forces between forces which act in an opening manner and forces which act in a closing manner occurs at the first main valve after the open state of the first main valve 1 is reached, with the result that pressure fluctuations can lead to undesired closing.

In other words, the first main valve of the present invention then comprises four instead of the known three control or active faces. Of the four control faces, two act in a closing manner and two act in an opening manner. In addition, one of the control faces which act in a closing manner is connected permanently to the low pressure line and, via the latter, to the low pressure tank. Here, the sizes of the control faces which act in an opening manner in relation to the sizes of the control faces which act in a closing manner are selected in such a way that the first main valve remains reliably in the open state even in the case of pressure fluctuations.

In one refinement, the sum of the size of the first control face of the first main valve and the size of the fourth control face of the first main valve is greater than the size of the second control face of the first main valve, the sum of the size of the first control face of the first main valve and the size of the fourth control face of the first main valve being exactly as great as the sum of the size of the second control face of the first main valve and the size of the third control face of the first main valve in one particularly preferred refinement. Since the third control face is connected permanently to the low pressure line, only the first, second and fourth control face are at high pressure in the open state of the first main valve. Should undesired pressure increases occur at the second control face which is connected directly to the high pressure line, the opening action of the first and fourth control faces which are larger together and are increased here, in particular, by the amount of the size of the third control face is sufficient to avoid undesired closing of the first main valve.

In a further refinement, the second control face of the first main valve is at least as large as the fourth control face of the first main valve. This ensures that the closing action of the second control face is sufficient to overcome the opening action of the fourth control face directly after the low pressure is applied to the first control face, and to initiate closing of the first main valve.

In a further embodiment, the second main valve is provided with a latching means which is based on spring force and latches in the open state of the second main valve. This ensures that the second main valve remains in the open state even after the high voltage power switch is switched off when the second main valve is completely without pressure. Said desired behavior is also called a switching position memory. If a latching means is not present, the second main valve would otherwise be closed automatically by way of the restoring spring which is present in the valve.

In a further embodiment, the first and/or the second main valve are/is provided with a manual restoring option, that is to say a manually actuable restoring option. In this way, a disadvantage of the known valve arrangements in accordance with FIG. 1 and/or FIG. 2 is eliminated, which disadvantage can occur in conjunction with transport, for example when delivering the power switch drive. During the transport, the entire two-stage valve arrangement is in the pressureless state, for which reason the two main valves are held in the respective switching positions merely by way of their own spring latching means or restoring spring. Should one or both of the main valves move into an intermediate position, for example triggered by way of vibration or shock loading, the situation might occur where the two main valves were open at the same time. In this case, the two-stage valve arrangement and therefore the drive might no longer be capable of being started up, since no pressure can be built up. Instead, a pump would convey the fluid which is usually a hydraulic oil merely in a circuit, since the main valves would permit a direct throughflow from the high pressure line to the low pressure line, that is to say from the actual high pressure region into the low pressure tank.

By means of the manual restoring option, the main valve which is affected by vibration-induced movement can then be moved back into its starting position, with the result that starting up can take place in an unimpeded manner.

BRIEF DESCRIPTION OF THE DRAWINGS

The invention and its possible configuration are to be described in greater detail using the exemplary embodiments which are shown in the further drawings, in which.

DETAILED DESCRIPTION OF THE DRAWINGS

Figure 2:
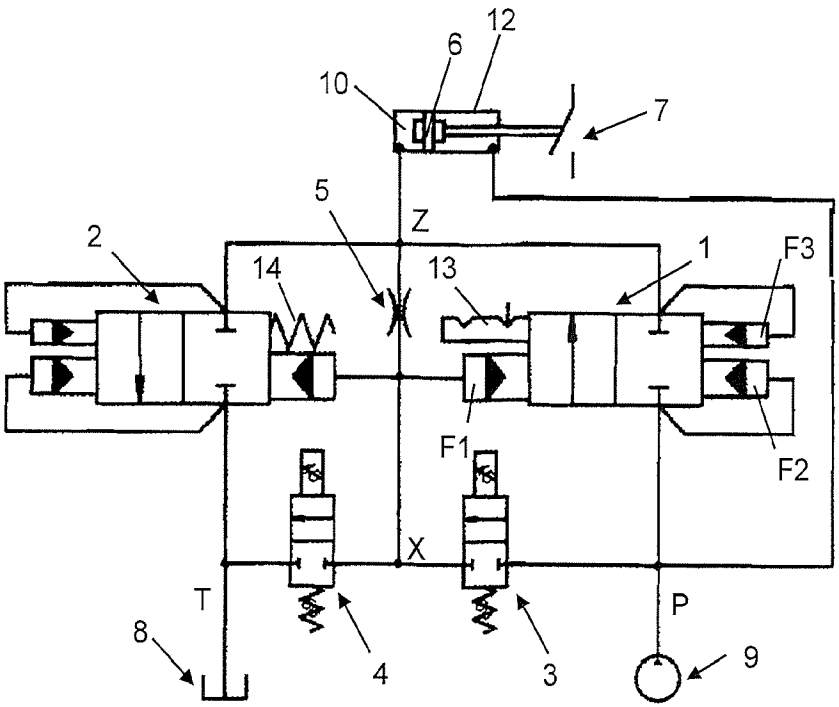
Fig. 2 (prior art)
FIG. 2 shows a second known two-stage valve arrangement having an orifice for discharging a leakage flow.
Figure 1:
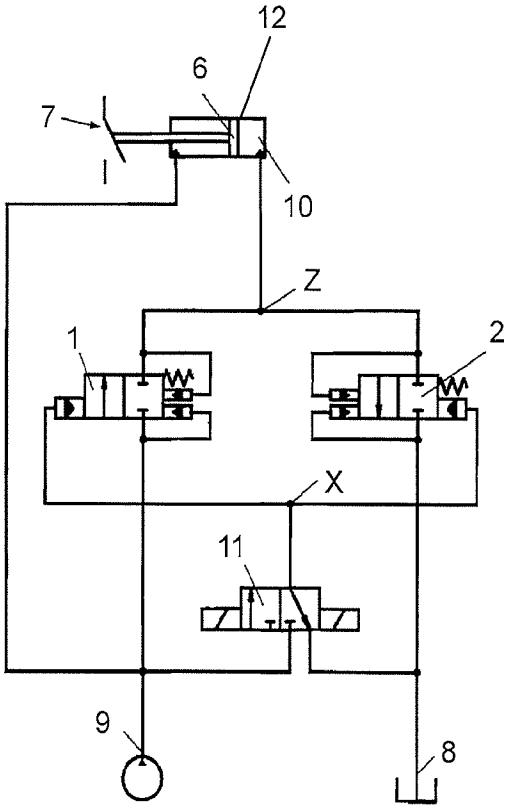
Fig. 1 (prior art)
FIG. 1 shows a first known two-stage valve arrangement for the actuation of a piston and therefore of a high voltage power switch.
Figure 3:
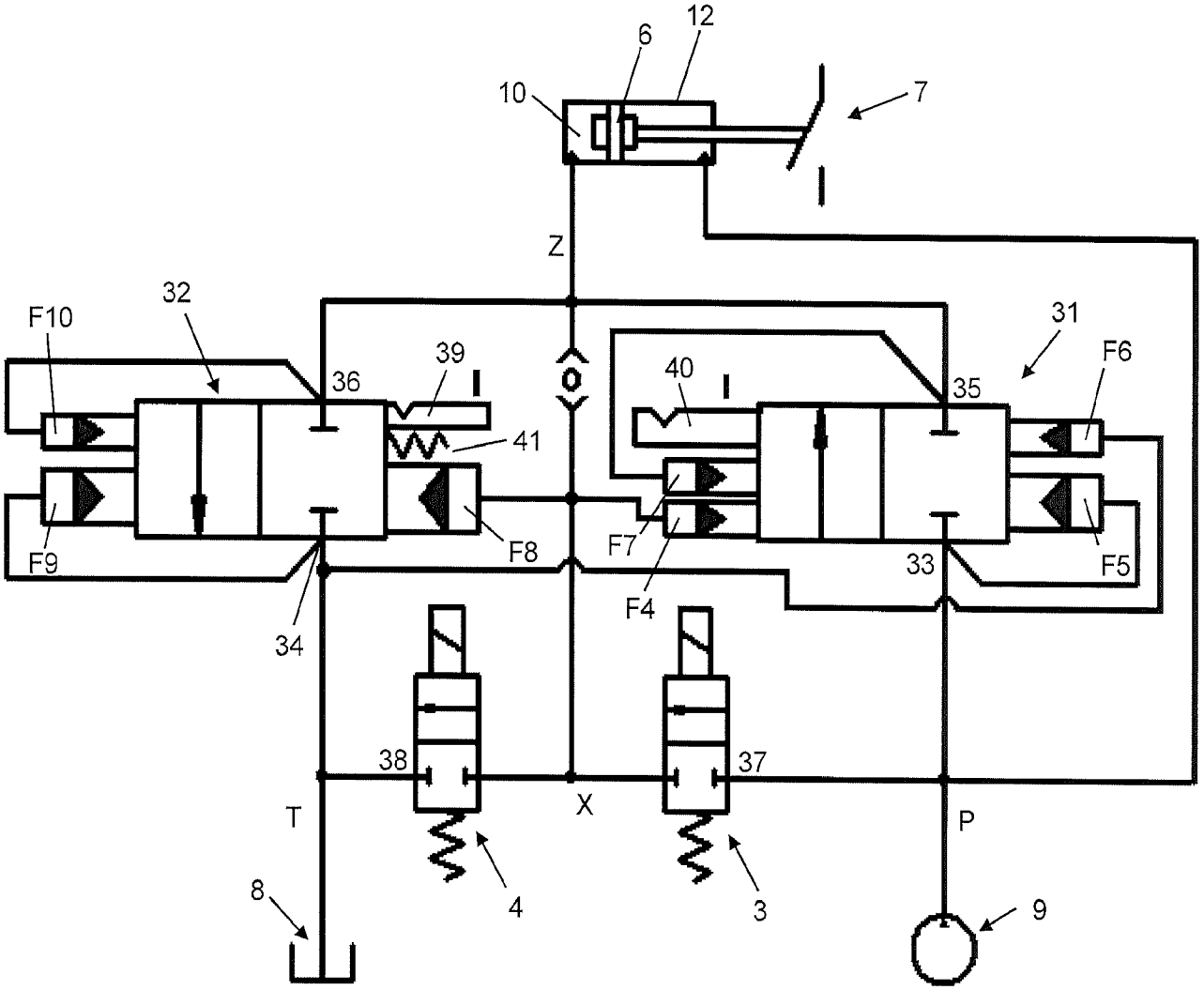
FIG. 3 shows a third two-stage valve arrangement in accordance with the invention.

FIG. 3 shows one possible embodiment of a two-stage valve arrangement in accordance with the invention. The two-stage valve arrangement serves for the hydraulic actuation of a piston 6 in a cylinder 12 of a high voltage or medium voltage power switch 7. Here, the two-stage valve arrangement comprises a main stage with two 2/2-way valves which are called a first main valve and a second main valve 32, and a pilot control stage with two 2/2-way valves which are called a first pilot control valve 3 and a second pilot control valve 4. Here, identical designations are used for the consistent elements in FIGS. 1 and 2.

A high pressure line P which conducts a fluid under high pressure is connected directly to an inlet-side valve connector 33 of the first main valve 31, and is fed from a high pressure accumulator 9. The fluid is preferably a hydraulic oil, but can also be compressed air, for example. A low pressure line T is connected directly to an inlet-side valve connector 34 of the second main valve 32, the low pressure line T conducting the fluid under low pressure and being connected to a low pressure tank 8.

On the inlet side, the pilot control stage has two connectors, one of the connectors, to be precise the inlet-side connector 37 of the first pilot control valve 3, being connected to the high pressure line P, and the other one of the connectors, namely the inlet-side connector 38 of the second pilot control valve 4, being connected to the low pressure line T.

An outlet-side valve connector 35 of the first main valve 31 and an outlet-side valve connector 36 of the second main valve 32 are connected to one another at a hydraulic connecting node Z, and are connected via the latter to a space 10 which is situated on one side of the piston 6, that is to say the outlet-side valve connectors 35, 36 of the main valves 31, 32 feed directly into the space 10.

The pilot control stage has a hydraulic pilot control outlet X which is connected in each case to the outlet-side connector of the first and second pilot control valve 3, 4. The pilot control outlet X in turn is connected to a first control face F4, acting in an opening manner, of the first main valve 31 and to a first control face F8, acting in a closing manner, of the second main valve 32.

In a first position of the pilot control valves 3, 4, the pilot control stage establishes a connection between the high pressure line P and the hydraulic pilot control outlet X. In said first position, the first pilot control valve 3 is open and the second pilot control valve 4 is closed. The high pressure which thereupon acts on the first control faces F4, F8 of the main valves 31, 32 brings about opening of the first main valve 31 and closing of the second main valve 32, with the result that the fluid under high pressure is fed to the space 10 which is situated on one side of the piston 6, as a result of which the high voltage or medium voltage power switch 7 is switched on, that is to say is closed.

In a second position of the pilot control valve 3, 4, the pilot control stage establishes a connection between the low pressure line T and the hydraulic pilot control outlet X. In said second position, the first pilot control valve 3 is closed and the second pilot control valve 4 is open. The low pressure which thereupon acts on the first control faces F4, F8 of the main valves 31, 32 brings about closing of the first main valve 31 and opening of the second main valve 32, with the result that fluid is discharged in the direction of the low pressure line T from the space 10 which is situated on one side of the piston 6, which leads to switching off, that is to say opening, of the high voltage or medium voltage power switch 7.

Figure 4:
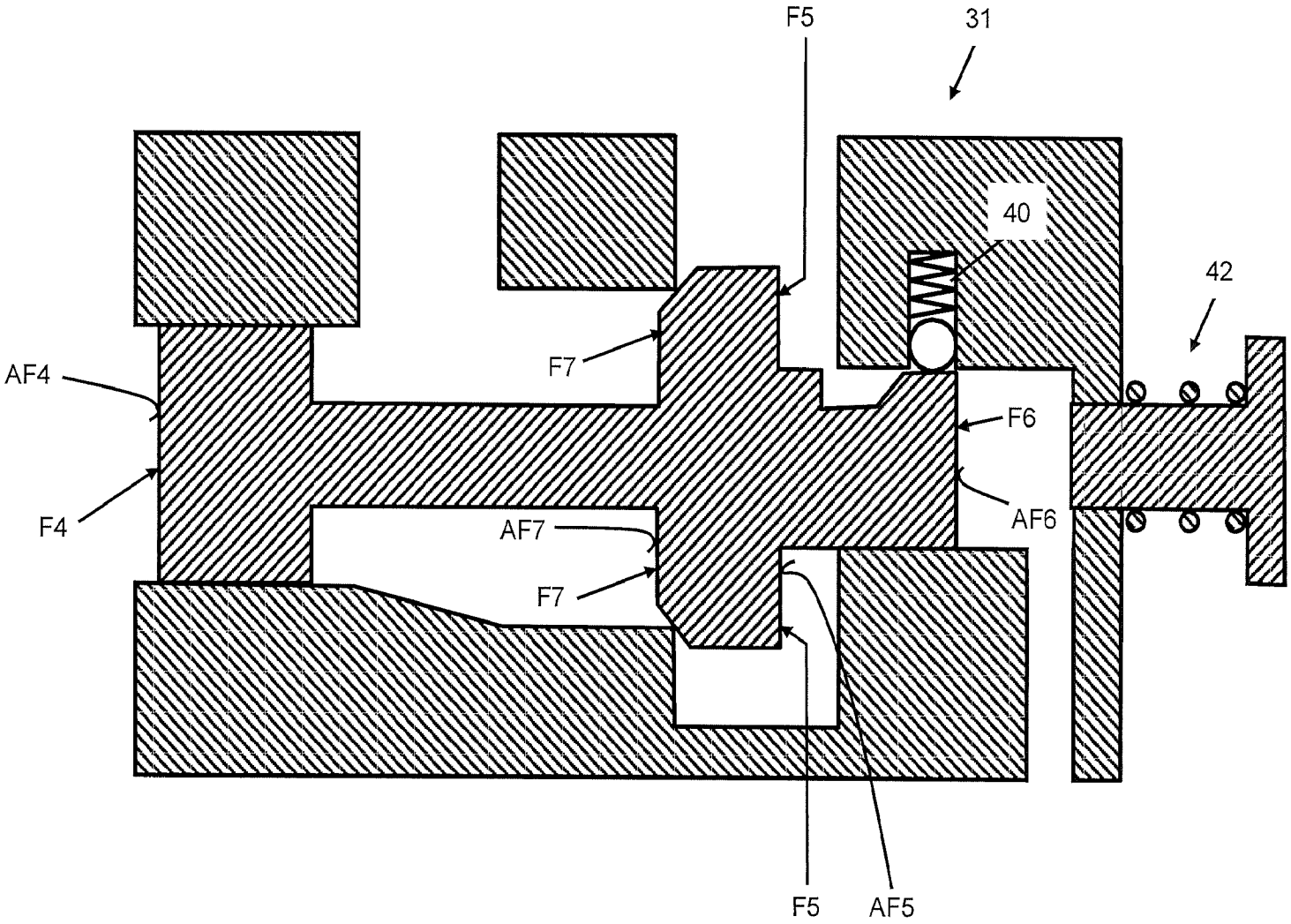
FIG. 4 shows one embodiment of the first main valve from FIG. 3.

According to the invention, the first main valve 31 has three further control faces, as can also be gathered from FIG. 4 which shows one possible embodiment of the first main valve 31. In addition to the first control face F4 of the first main valve, which first control face F4 acts in an opening manner, there are a second and a third control face F5 and F6 of the first main valve which both act in a closing manner. A fourth control face F7 of the first main valve in turn acts in an opening manner.

The second control face F5 of the first main valve is connected within the two-stage valve arrangement to the high pressure line P; the third control face F6 of the first main valve is connected to the low pressure line T, and the fourth control face F7 of the first main valve is connected to the outlet-side valve connector 35 of the first main valve 31.

In accordance with the invention, the area ratio of the control faces F4 and F7, acting in an opening manner, of the first main valve with respect to the control faces F5 and F6, acting in a closing manner, of the first main valve is such that a resulting force which acts in an opening manner remains in force in the open state of the first main valve, with the result that the first main valve 31 remains reliably in the open state, even if pressure fluctuations should occur in the high pressure line P.

In the following text, the area size of the first control face F4 of the first main valve is denoted by AF4, and the area sizes of the remaining control faces F5, F6, F7 of the first main valve are denoted analogously by AFS, AF6 and AF7. In the embodiment in accordance with FIG. 4, the area sizes AF4, AFS, AF6 and AF7 are selected in such a way that the sum of the size of the first control face (AF4) of the first main valve and the size of the fourth control face (AF7) of the first main valve is precisely as great as the sum of the size of the second control face (AF5) of the first main valve and the size of the third control face (AF6) of the first main valve, that is to say AF4+AF7=AF5+AF6. In this way, the condition is also met at the same time that the sum of the size of the first control face (AF4) of the first main valve and the size of the fourth control face (AF7) of the first main valve is greater than the size of the second control face (AF5), that is to say AF4+AF7>AF5. Moreover, the second control face of the first main valve is at least as large as the fourth control face of the first main valve, that is to say AF5≥AF7. In the refinement in accordance with FIG. 4, the former size ratio ensures that, in the open state of the first main valve 31, if high pressure prevails against the first (F4), second (F5) and fourth (F7) control face, an unexpected increase in the pressure at the second control face F5 does not lead to undesired closing of the first main valve. The latter size ratio ensures that, at the beginning of a desired closing operation of the first main valve 31, if a change is made from high pressure to low pressure at the first control face F4, the high pressure at the second control face F5 is sufficient to initiate the closing operation.

As shown in FIGS. 3 and 4, moreover, the first main valve 31 has a latching means 40 which is based on spring force and ensures that the first main valve 31 remains as reliably as possible in the open state, until a sufficiently great closing force counteracts this.

Moreover, the first main valve 31 is provided with a manual restoring option 42, with the aid of which the first main valve can be moved into the closed state again after a transport-induced movement.

Figure 5:
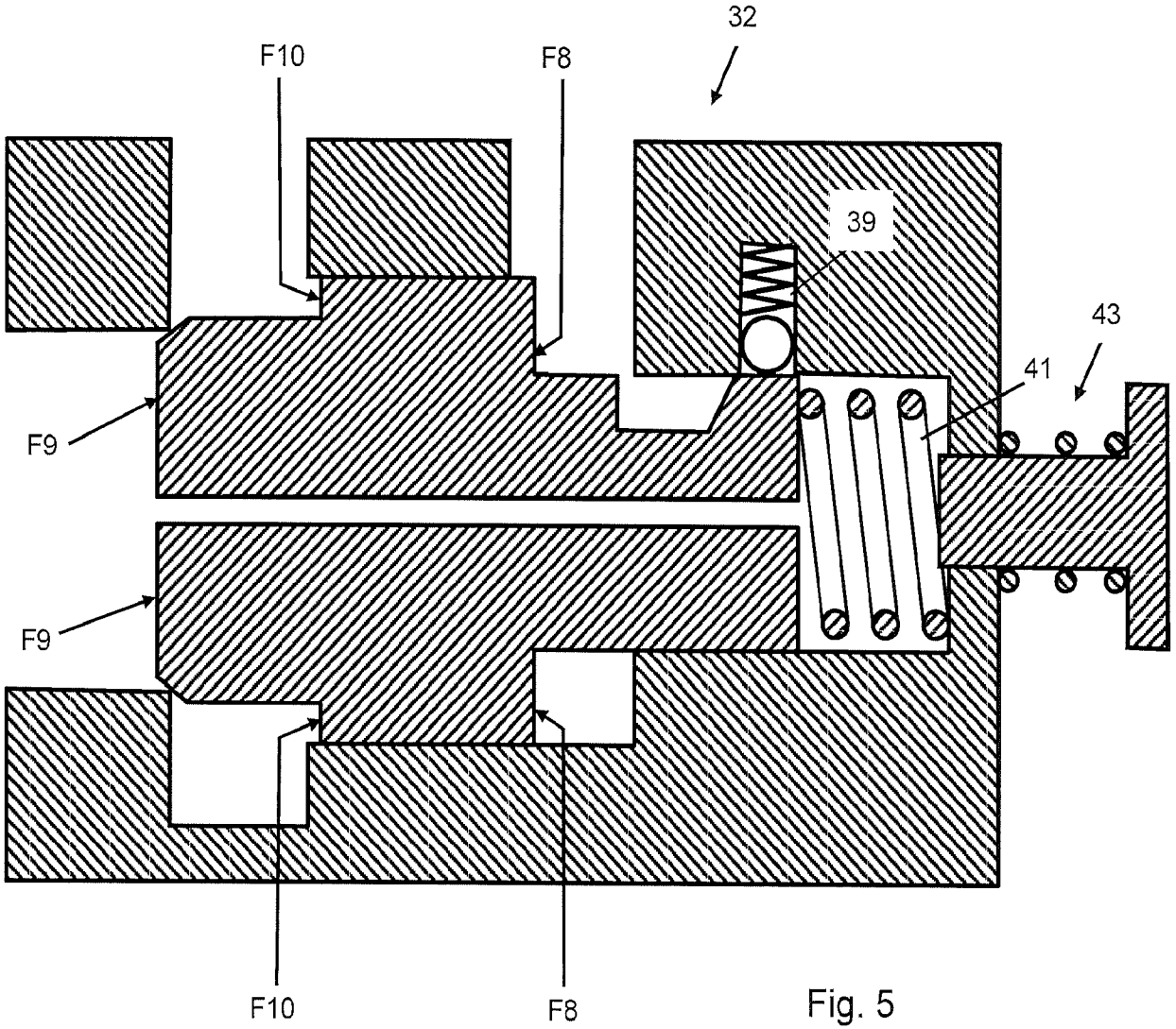
FIG. 5 shows one embodiment of the second main valve from FIG. 3.

FIG. 5 shows one possible refinement of the second main valve 32. Said second main valve 32 has a total of three control faces, that is to say, in addition to the first control face F8, a second control face F9 of the second main valve, and a third control face F10 of the second main valve. In the two-stage valve arrangement in accordance with FIG. 3, the second control face F9 of the second main valve is connected to the low pressure line T, and the third control face F10 of the second main valve is connected to the outlet-side valve connector 36 of the second main valve 32.

The second main valve 32 is also provided with a latching means 39 which is based on spring force and latches in in the open state of the second main valve. Here, said latching means 39 which is based on spring force counteracts, in particular, the introduction of force of the restoring spring 41, with the result that a switching position memory can be realized in this way, that is to say the second main valve is held in the open state even after the high voltage or medium voltage power switch 7 is switched off, if the second main valve is completely without pressure.

In the case of the second main valve 32 of FIG. 5, the restoring spring 41 is also supplemented by a manual restoring option 42, with the result that the second main valve can also be moved into the closed state again after a transport-induced movement and undesired latching in of the latching means 39.

The invention claimed is:

1. A two-stage valve arrangement for the hydraulic actuation of a piston in a cylinder of a high voltage or medium voltage power switch, the two-stage valve arrangement comprising:

a main stage with a first main valve configured as a 2/2-way valve and a second main valve configured as a 2/2-way valve, a high pressure line configured to conduct a fluid under high pressure being connected directly to an inlet-side valve connector of the first main valve, and a low pressure line configured to conduct a fluid under low pressure being connected directly to an inlet-side valve connector of the second main valve, an outlet-side valve connector of the first main valve and an outlet-side valve connector of the second main valve being connected hydraulically to one another and to a space situated on one side of the piston, and a pilot control stage with at least one pilot control valve having two connectors on the inlet side, one of the two connectors being connected to the high pressure line and the other of the two connectors being connected to the low pressure line, a hydraulic pilot control outlet of the pilot control stage being connected both to a first control face of the first main valve, to act in an opening manner, and to a first control face of the second main valve, to act in a closing manner, wherein the pilot control stage is configured to establish a connection between the high pressure line and the hydraulic pilot control outlet in a first position of the at least one pilot control valve, such that the high pressure acts on the first control face of the first main valve and on the first control face of the second main valve to cause an opening of the first main valve and a closing of the second main valve, with the result that fluid under high pressure is fed to the space which is situated on the one side of the piston wherein the pilot control stage is configured to establish a connection between the low pressure line and the hydraulic pilot control outlet in a second position of the at least one pilot control valve, such that the low pressure acts on the first control face of the first main valve and on the first control face of the second main valve to cause a closing of the first main valve and an opening of the second main valve, with the result that fluid is discharged in a direction of the low pressure line from the space which is situated on the one side of the piston, wherein the first main valve further comprises a second control face configured to act in a closing manner, a third control face configured to act in a closing manner, and a fourth control face configured to act in an opening manner, the second control face of the first main valve being connected to the high pressure line, the third control face of the first main valve being connected to the low pressure line, and the fourth control face of the first main valve being connected to the outlet-side valve connector of the first main valve, and wherein a size ratio of the first and fourth control faces of the first main valve with respect to the second and third control faces of the first main valve is configured such that a resulting force which acts in an opening manner remains in force in an open state of the first main valve.

2. The two-stage valve arrangement as claimed in claim 1, wherein a sum of an area size of the first control face of the first main valve and an area size of the fourth control face of the first main valve is greater than an area size of the second control face of the first main valve.

3. The two-stage valve arrangement as claimed in claim 2, wherein the sum of the area size of the first control face of the first main valve and the area size of the fourth control face of the first main valve is equal to a sum of the area size of the second control face of the first main valve and an area size of the third control face of the first main valve.

4. The two-stage valve arrangement as claimed in claim 1, wherein the second control face of the first main valve is at least as large as the fourth control face of the first main valve.

5. The two-stage valve arrangement as claimed in claim 1, further comprising a spring-based latch configured to latch in an open state of the second main valve.

6. The two-stage valve arrangement as claimed in claim 1, wherein the second main valve further comprises a second control face connected to the low pressure line and a third control face connected to the outlet-side valve connector of the second main valve.

7. The two-stage valve arrangement as claimed in claim 1, wherein the pilot control stage comprises two 2/2-way valves as pilot control valves.

8. The two-stage valve arrangement as claimed in claim 1, wherein the first main valve is provided with a manual restoring option.

9. The two-stage valve arrangement as claimed in claim 1, wherein the second main valve is provided with a manual restoring option.

10. The two-stage valve arrangement as claimed in claim 1, wherein the first and second main valves are each provided with a manual restoring option.

* * * * *